US008770535B1

(12) United States Patent
Yu

(10) Patent No.: US 8,770,535 B1
(45) Date of Patent: Jul. 8, 2014

(54) MUSICAL INSTRUMENT STAND

(71) Applicant: Tsung-Yao Yu, Taichung (TW)

(72) Inventor: Tsung-Yao Yu, Taichung (TW)

( * ) Notice: Subject to any disclaimer, the term of this patent is extended or adjusted under 35 U.S.C. 154(b) by 0 days.

(21) Appl. No.: 13/761,414

(22) Filed: Feb. 7, 2013

(51) Int. Cl.
*G10G 5/00* (2006.01)
*A47B 23/00* (2006.01)

(52) U.S. Cl.
CPC ..... *G10G 5/00* (2013.01); *A47B 23/004* (2013.01)
USPC ..... 248/443; 248/122.1; 248/276.1; 211/85.6

(58) Field of Classification Search
CPC ..... G10G 5/00; A47B 23/004
USPC ..... 248/441.1, 443, 127, 121, 122.1, 163.1, 248/371, 274.1, 276.1; 84/327, 329; 211/85.6, 198, 204, 124, 168, 170, 211/171; 206/314, 757
See application file for complete search history.

(56) References Cited

U.S. PATENT DOCUMENTS

| | | | | |
|---|---|---|---|---|
| 6,296,213 | B1 * | 10/2001 | Law et al. | 248/166 |
| 6,540,182 | B1 * | 4/2003 | Wilfer | 248/121 |
| 7,077,365 | B2 * | 7/2006 | Vincak | 248/122.1 |
| 8,042,229 | B2 * | 10/2011 | Wang | 16/270 |
| D679,117 | S * | 4/2013 | Werner et al. | D6/682.4 |
| 8,490,942 | B1 * | 7/2013 | Henry | 248/441.1 |

* cited by examiner

*Primary Examiner* — Todd M Epps
(74) *Attorney, Agent, or Firm* — Alan Kamrath; Kamrath IP Lawfirm, P.A.

(57) ABSTRACT

A musical instrument stand includes a frame unit, and at least one support unit. The frame unit includes two side modules, a top bar mounted between the side modules, and a bottom bar mounted between the side modules. The support unit includes a supporting seat for supporting a musical instrument, and a mounting sleeve connected with the supporting seat and rotatably mounted on the bottom bar of the frame unit. Thus, the support unit is pivotally mounted on the frame unit, so that a user only needs to place the musical instrument on the support unit and to push the musical instrument toward the top bar of the frame unit, so as to pivot the support unit and to support the musical instrument between the top bar of the frame unit and the supporting seat of the support unit.

6 Claims, 10 Drawing Sheets

MUSICAL INSTRUMENT STAND

BACKGROUND OF THE INVENTION

1. Field of the Invention

The present invention relates to a stand and, more particularly, to a musical instrument stand.

2. Description of the Related Art

A conventional musical instrument stand 1 in accordance with the prior art shown in FIGS. 1 and 2 comprises two side frames 11, a top bar 13, and two bottom bars 12. Each of the side frames 11 has a substantially L-shaped profile and has an upright bar 112 and a transverse bar 111. The top bar 13 is mounted between the side frames 11 and includes a mounting sleeve 131 mounted between the upright bars 112 of the side frames 11, and a plurality of separation members 132 mounted on the mounting sleeve 131. Each of the bottom bars 12 is mounted between the transverse bars 111 of the side frames 11. In use, when a musical instrument 14, such as a guitar and the like, is placed on the musical instrument stand 1, the bottom of the musical instrument 14 is located between the bottom bars 12, and the top of the musical instrument 14 rests on the mounting sleeve 131 of the top bar 13 and is located between the separation members 132 of the top bar 13. Thus, the conventional musical instrument stand 1 is used to support multiple musical instruments 14 which are spaced by the separation members 132 of the top bar 13. However, the bottom bars 12 and the top bar 13 are fixed and cannot be adjusted to fit the position of the musical instrument 14, so that when the musical instrument 14 is not placed between the bottom bars 12 and the top bar 13 steadily and stably, the musical instrument 14 easily slips or falls out of the conventional musical instrument stand 1 due to an unsteady center of gravity, and will be worn or broken due to hit. In addition, it is necessary to align the musical instrument 14 with the separation members 132 so as to insert the musical instrument 14 between any two of the separation members 132, thereby causing inconvenience to the user when placing and taking the musical instrument 14.

BRIEF SUMMARY OF THE INVENTION

In accordance with the present invention, there is provided a musical instrument stand, comprising a frame unit, and at least one support unit mounted on the frame unit. The frame unit includes two side modules spaced from each other, a top bar mounted between the side modules, and a bottom bar mounted between the side modules and located under the top bar. The support unit is pivotally mounted on the bottom bar of the frame unit. The support unit includes a supporting seat for supporting a musical instrument, and a mounting sleeve connected with the supporting seat and rotatably mounted on the bottom bar of the frame unit. The mounting sleeve of the support unit is located at a bottom of the supporting seat and is rotatable along its axis.

The supporting seat of the support unit has a front end portion and a second end portion. The front end portion and the second end portion of the supporting seat are located at two opposite sides of the mounting sleeve. A first distance is defined between the front end portion of the supporting seat and the mounting sleeve. A second distance is defined between the second end portion of the supporting seat and the mounting sleeve. The first distance is greater than the second distance.

The musical instrument stand further comprises at least one spacer mounted on the frame unit and abutting the support unit. The spacer is mounted on the bottom bar of the frame unit and abuts one end of the mounting sleeve of the support unit.

The support unit further includes a slideway formed in one of the mounting sleeve and the spacer, and a positioning boss formed on the other one of the mounting sleeve and the spacer and slidable in the slideway. The slideway has a front end provided with a first stop portion corresponding to the front end portion of the supporting seat and a rear end provided with a second stop portion corresponding to the second end portion of the supporting seat. The support unit is movable relative to the frame unit between a first position where the positioning boss is stopped by the second stop portion of the slideway, and a second position where the positioning boss is stopped by the first stop portion of the slideway.

The musical instrument stand comprises a plurality of support units pivotally mounted on the bottom bar of the frame unit, and a plurality of spacers mounted on the bottom bar of the frame unit and located between the support units. The mounting sleeve of each of the support units has two opposite ends each abutting a respective one of the spacers.

Each of the side modules of the frame unit includes a side bar abutting the top bar and the bottom bar, two connectors each detachably locked onto the side bar and each connected with a respective one of the top bar and the bottom bar, a connecting seat detachably mounted on the side bar, and a support bar detachably connected with the connecting seat and inclined relative to the side bar to support the side bar. The side bar of each of the side modules is arranged in an inclined manner.

The primary objective of the present invention is to provide a musical instrument stand that is used to place and support a musical instrument easily and quickly.

According to the primary advantage of the present invention, the support unit is pivotally mounted on the bottom bar of the frame unit, so that a user only needs to place the musical instrument on the support unit and to push the musical instrument toward the top bar of the frame unit, so as to pivot the support unit and to support the musical instrument between the top bar of the frame unit and the supporting seat of the support unit, such that the musical instrument is placed on the musical instrument stand easily and quickly.

According to another advantage of the present invention, the musical instrument is directly placed on the support unit and the top bar of the frame unit, so that the user needs not to align the musical instrument with the top bar of the frame unit, thereby facilitating the user putting the musical instrument stand.

According to a further advantage of the present invention, the support unit is pivoted forward by its weight unbalance after the musical instrument is removed from the support unit so that the support unit is returned to the initial position automatically.

According to a further advantage of the present invention, the top bar and the bottom bar of the frame unit are arranged in an inclined manner, so that the musical instrument is supported solidly and stably between the support unit and the frame unit and will not fall out of the musical instrument stand due to an unsteady center of gravity, thereby assuring the safety of placement of the musical instrument.

According to a further advantage of the present invention, the parts of the frame unit can be detached, thereby facilitating and decreasing the cost of packaging, transportation and storage of the musical instrument stand.

According to a further advantage of the present invention, the number of the support units can be changed and adjusted according the user's requirement, thereby enhancing the versatility of the musical instrument stand.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
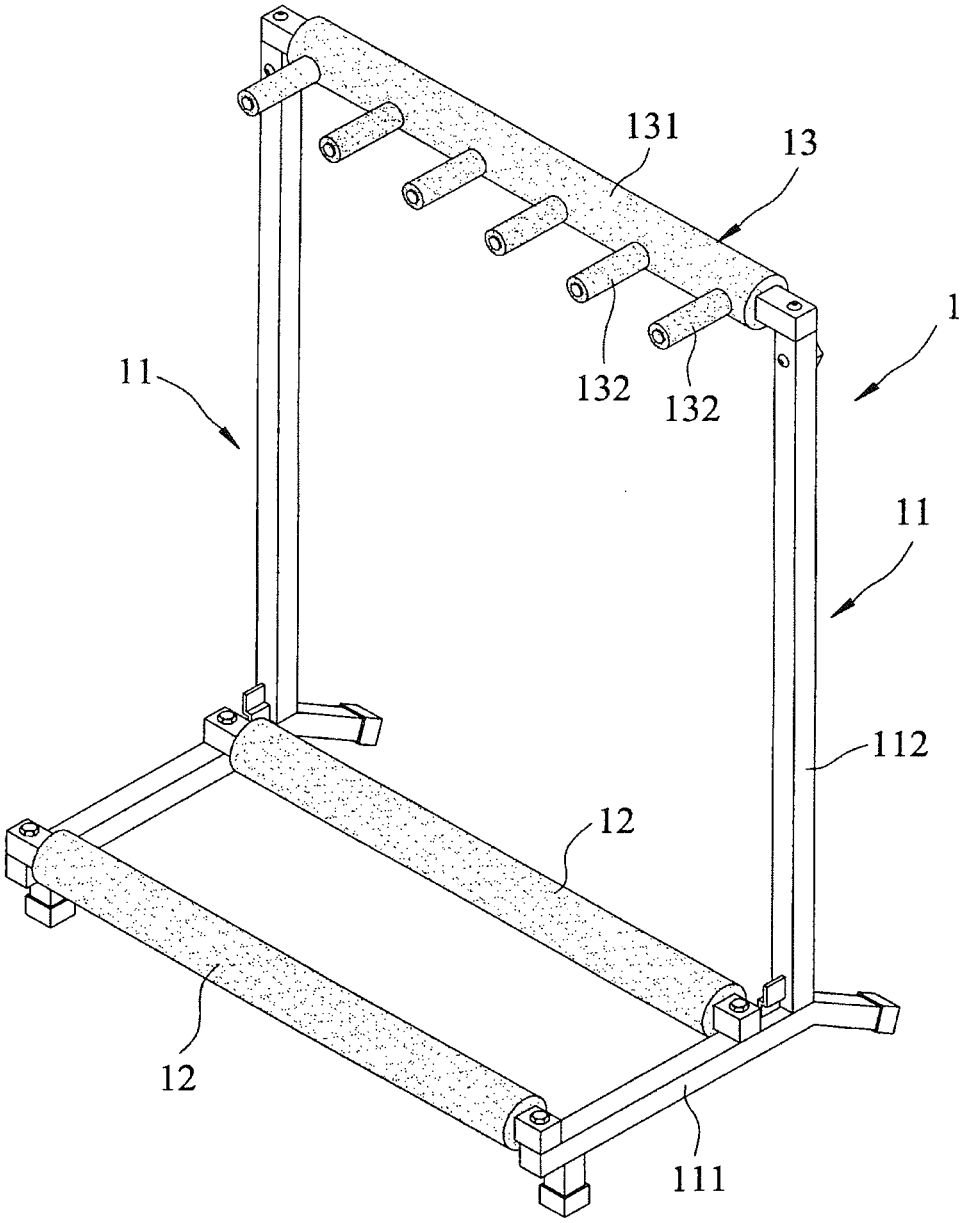
FIG. 1 PRIOR ART
FIG. 1 is a perspective view of a conventional musical instrument stand in accordance with the prior art.
Figure 2:
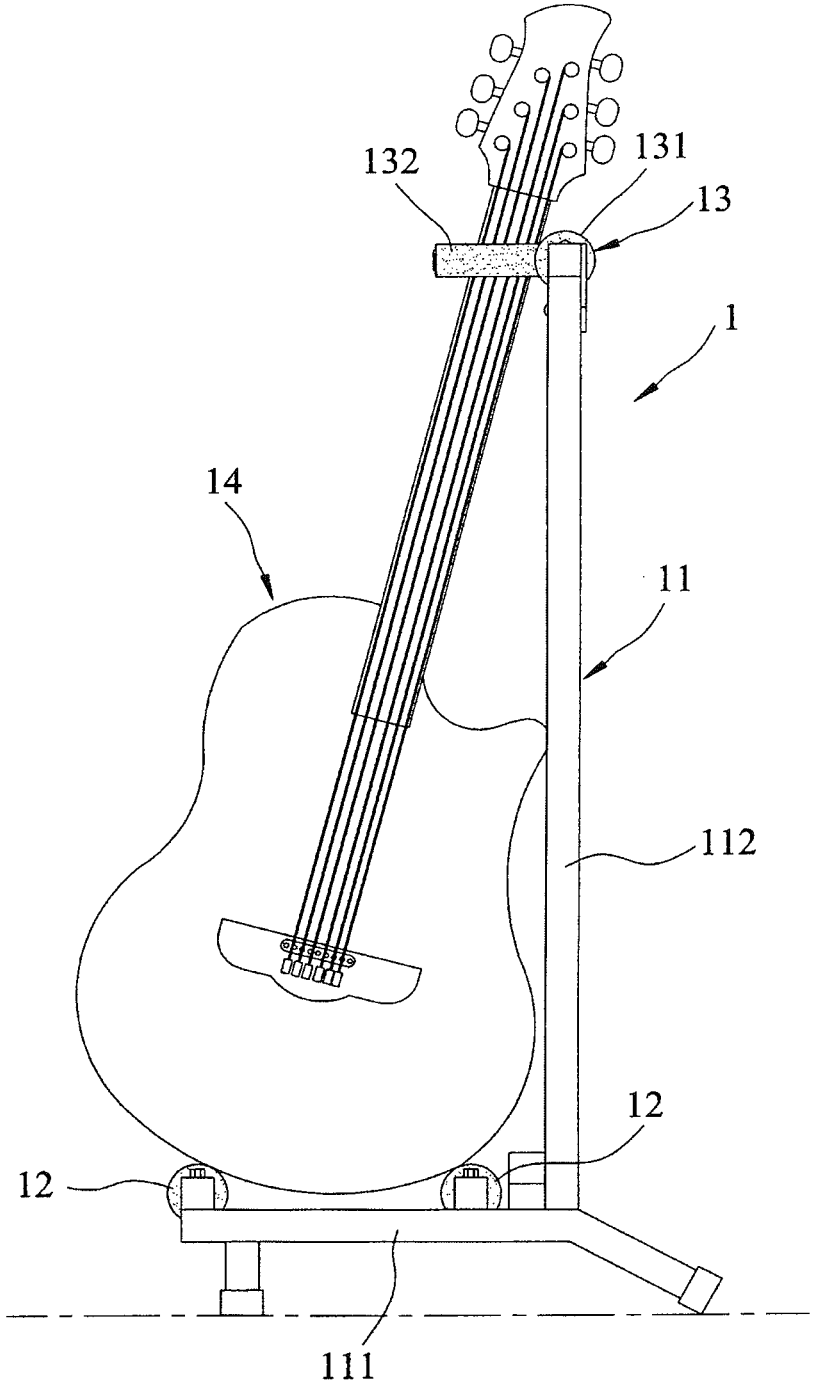
FIG. 2 PRIOR ART
FIG. 2 is a side view of the conventional musical instrument stand as shown in FIG. 1.

Referring to the drawings and initially to FIGS. 3-7, a musical instrument stand 2 in accordance with the preferred embodiment of the present invention comprises a frame unit 3, at least one support unit 4 mounted on the frame unit 3, and at least one spacer 5 mounted on the frame unit 3 and abutting the support unit 4.

The frame unit 3 includes two side modules 33 spaced from each other, a top bar 32 mounted between the side modules 33, and a bottom bar 31 mounted between the side modules 33 and located under the top bar 32.

Each of the side modules 33 of the frame unit 3 includes a side bar 331 abutting the top bar 32 and the bottom bar 31, two connectors 332 each detachably locked onto the side bar 331 and each connected with a respective one of the top bar 32 and the bottom bar 31, a connecting seat 333 detachably mounted on the side bar 331, and a support bar 334 detachably connected with the connecting seat 333 and inclined relative to the side bar 331 to support the side bar 331. The side bar 331 of each of the side modules 33 is arranged in an inclined manner.

The support unit 4 is pivotally mounted on the bottom bar 31 of the frame unit 3. The support unit 4 includes a supporting seat 41 for supporting a musical instrument 20 (see FIGS. 8 and 9), such as a guitar and the like, and a mounting sleeve 42 connected with the supporting seat 41 and rotatably mounted on the bottom bar 31 of the frame unit 3.

The mounting sleeve 42 of the support unit 4 is located at a bottom of the supporting seat 41 and is rotatable along its axis.

The supporting seat 41 of the support unit 4 has a front end portion 411 and a second end portion 412. The front end portion 411 and the second end portion 412 of the supporting seat 41 are located at two opposite sides of the mounting sleeve 42. A first distance "D1" is defined between the front end portion 411 of the supporting seat 41 and the mounting sleeve 42. A second distance "D2" is defined between the second end portion 412 of the supporting seat 41 and the mounting sleeve 42. The first distance "D1" is greater than the second distance "D2".

The spacer 5 is mounted on the bottom bar 31 of the frame unit 3 and abuts one end of the mounting sleeve 42 of the support unit 4.

The support unit 4 further includes a slideway 44 formed in one of the mounting sleeve 42 and the spacer 5, and a positioning boss 43 formed on the other one of the mounting sleeve 42 and the spacer 5 and slidable in the slideway 44. In the preferred embodiment of the present invention, the slideway 44 is formed in the spacer 5, and the positioning boss 43 is formed on the mounting sleeve 42. The slideway 44 has a front end provided with a first stop portion 441 corresponding to the front end portion 411 of the supporting seat 41 and a rear end provided with a second stop portion 442 corresponding to the second end portion 412 of the supporting seat 41. The support unit 4 is movable relative to the frame unit 3 between a first (or initial) position as shown in FIG. 6 where the positioning boss 43 is stopped by the second stop portion 442 of the slideway 44, and a second (or supporting) position as shown in FIG. 7 where the positioning boss 43 is stopped by the first stop portion 441 of the slideway 44.

Figure 3:
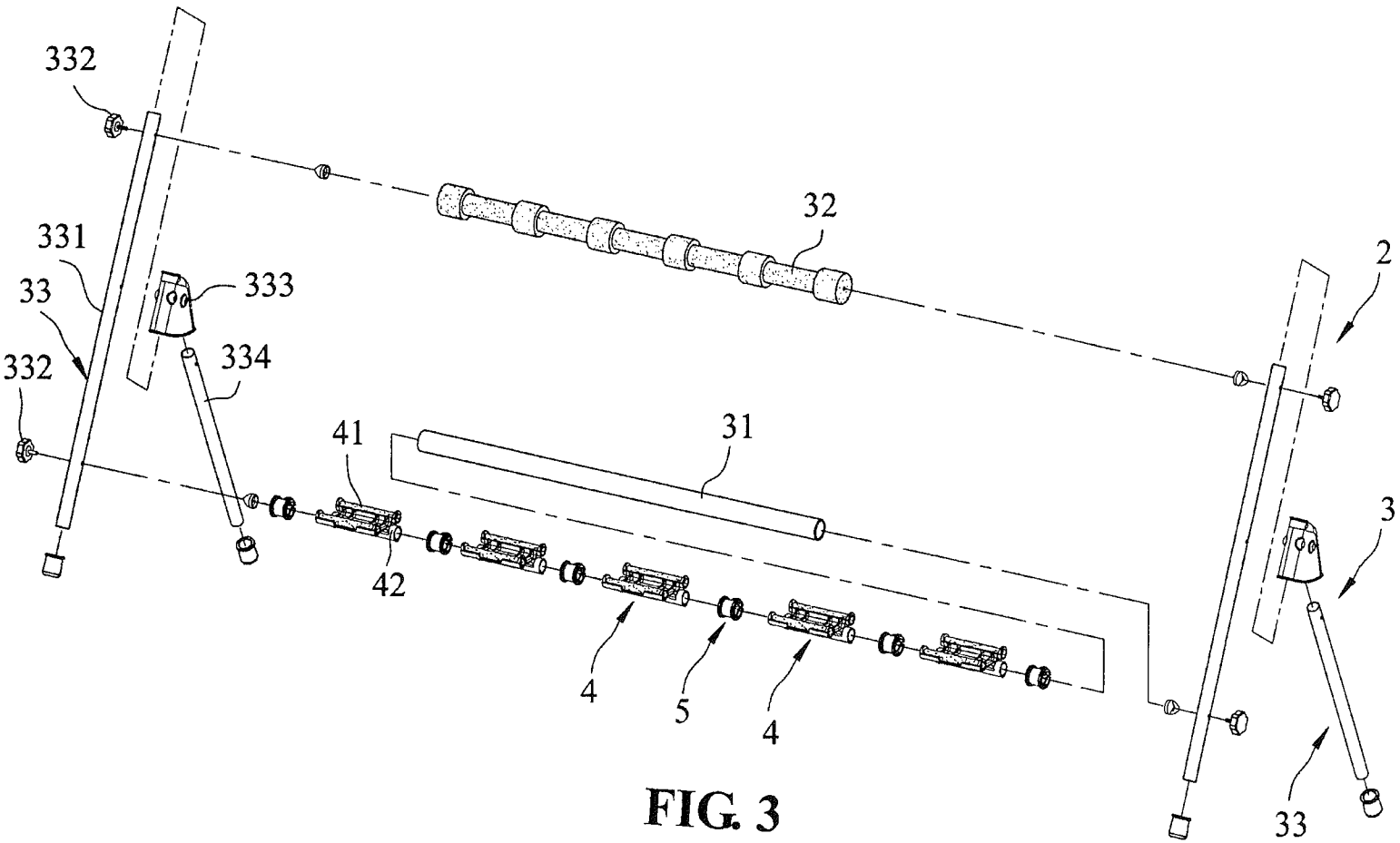
FIG. 3 is an exploded perspective view of a musical instrument stand in accordance with the preferred embodiment of the present invention.
Figure 4:
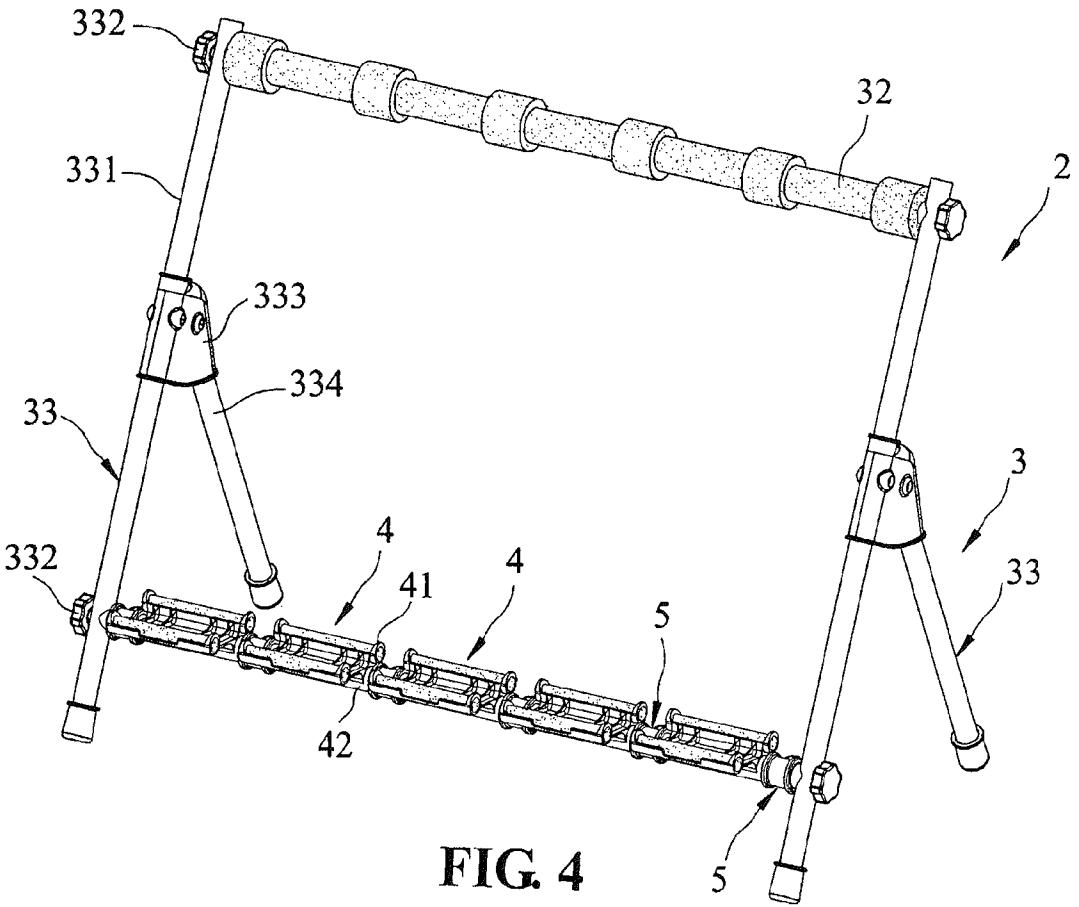
FIG. 4 is a perspective assembly view of the musical instrument stand as shown in FIG. 3.
Figure 5:
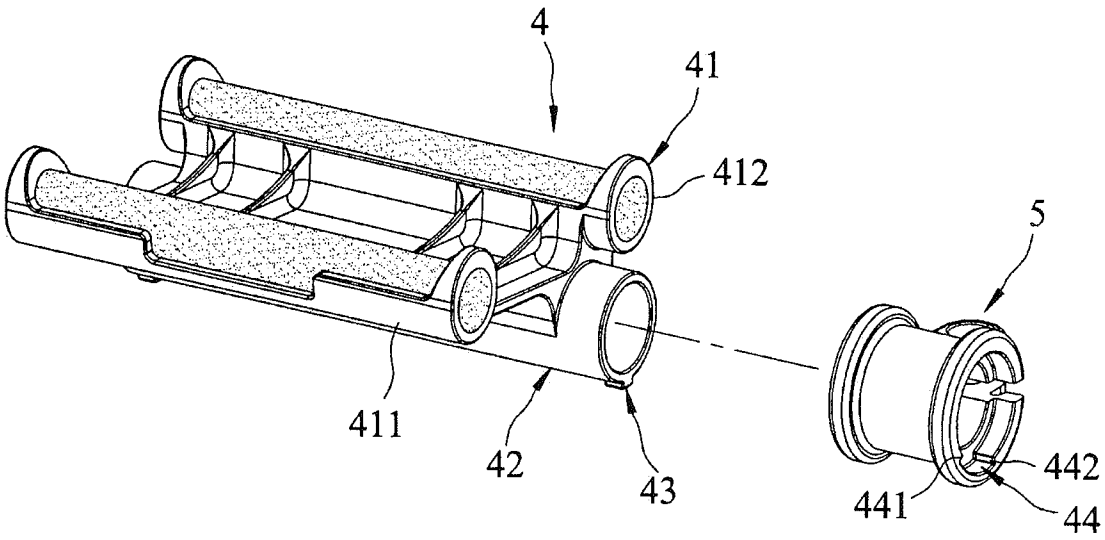
FIG. 5 is a locally enlarged view of the musical instrument stand as shown in FIG. 3.
Figure 6:
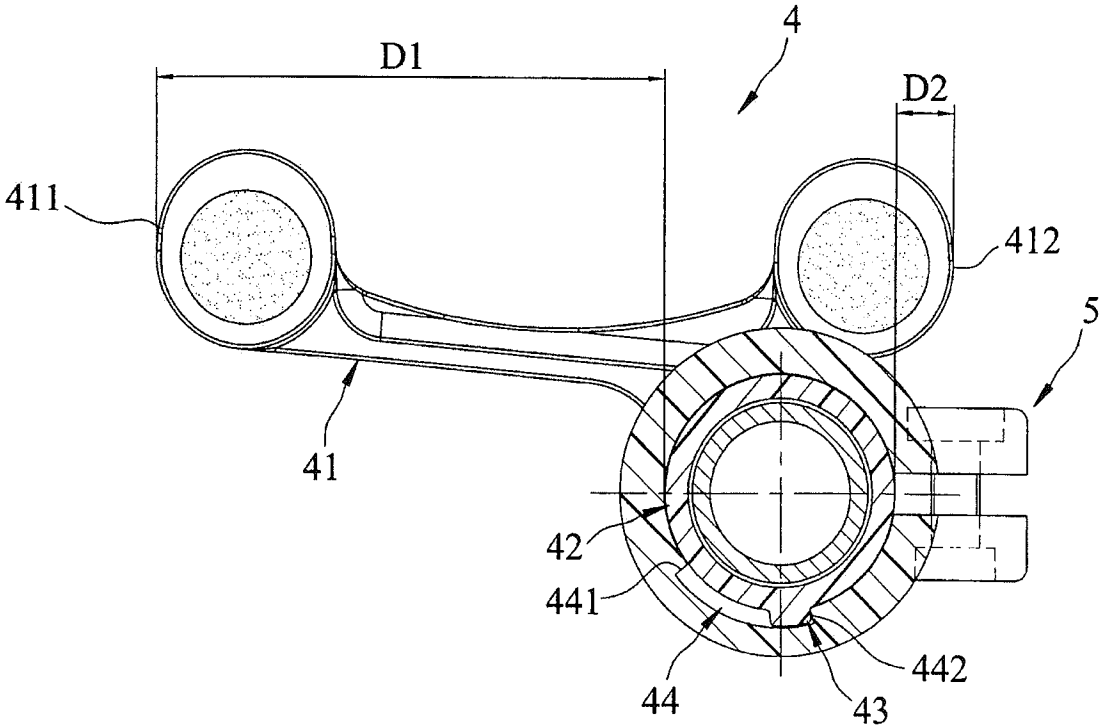
FIG. 6 is a side cross-sectional assembly view of the musical instrument stand as shown in FIG. 5.
Figure 7:
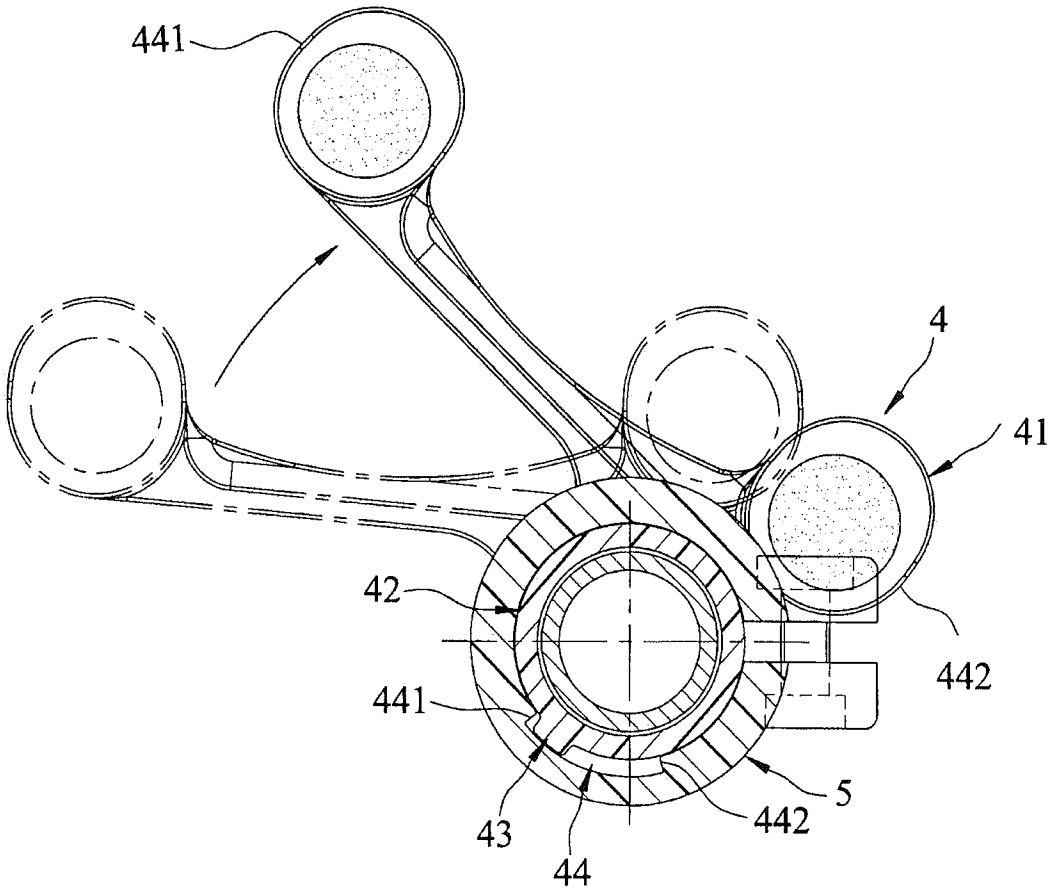
FIG. 7 is a schematic operational view of the musical instrument stand as shown in FIG. 6.
Figure 8:
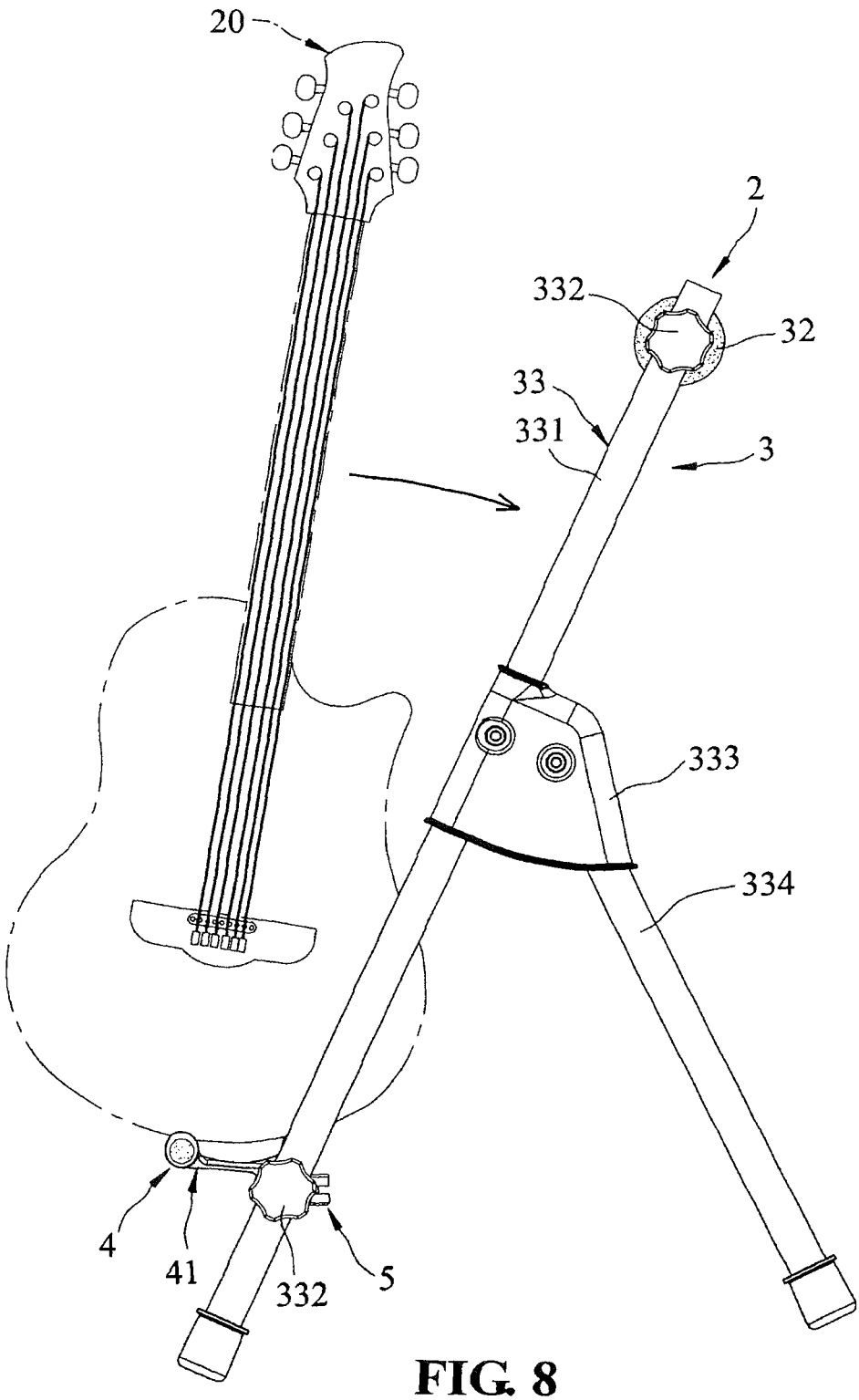
FIG. 8 is a side operational view of the musical instrument stand as shown in FIG. 4.
Figure 9:
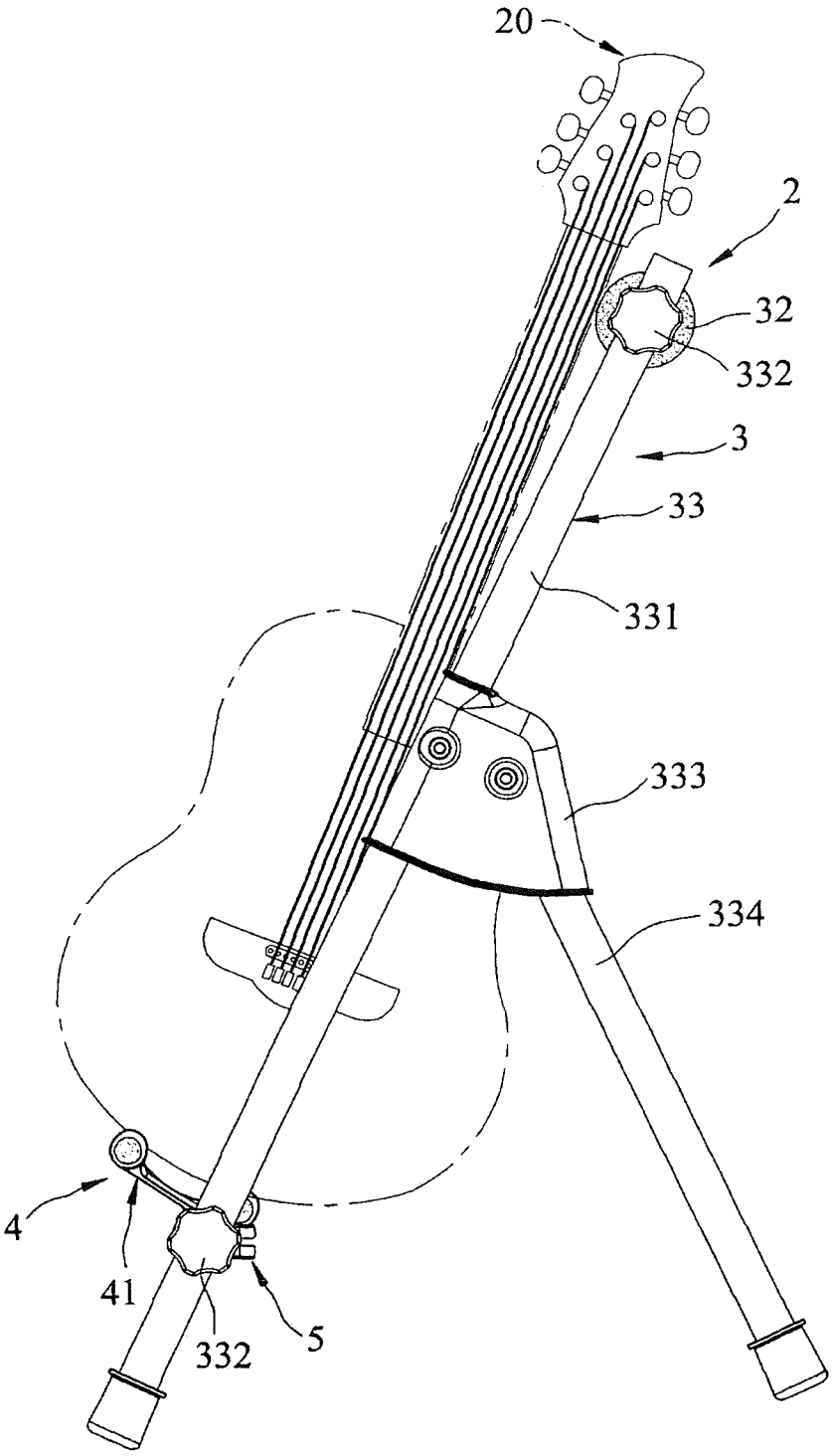
FIG. 9 is a schematic operational view of the musical instrument stand as shown in FIG. 8.

In operation, referring to FIGS. 6-9 with reference to FIGS. 3-5, the first distance "D1" defined between the front end portion 411 of the supporting seat 41 and the mounting sleeve 42 is greater than the second distance "D2" defined between the second end portion 412 of the supporting seat 41 and the mounting sleeve 42. The first distance "D1". In such a manner, when the support unit 4 is not subjected to a force, the support unit 4 is pivoted forward by its gravity, so that the front end portion 411 of the supporting seat 41 is moved downward, and the second end portion 412 of the supporting seat 41 is moved upward. Thus, the support unit 4 is pivoted forward about the bottom bar 31 of the frame unit 3 to the first (or initial) position as shown in FIG. 6 until the positioning boss 43 is stopped by the second stop portion 442 of the slideway 44. On the contrary, the bottom of the musical instrument 20 is placed on the supporting seat 41 of the support unit 4 as shown in FIG. 8. When the handle of the musical instrument 20 is moved toward the top bar 32 of the frame unit 3, the support unit 4 is driven by the musical instrument 20 to pivot backward, so that the front end portion 411 of the supporting seat 41 is moved upward, and the second end portion 412 of the supporting seat 41 is moved downward. In such a manner, the support unit 4 is pivoted backward about the bottom bar 31 of the frame unit 3 to the second (or supporting) position as shown in FIG. 7 until the positioning boss 43 is stopped by the first stop portion 441 of the slideway 44. Thus, the bottom of the musical instrument 20 is supported by the supporting seat 41 of the support unit 4, and the handle of the musical instrument 20 is supported by the top bar 32 of the frame unit 3 as shown in FIG. 9, so that the musical instrument 20 is supported solidly and stably between the support unit 4 and the frame unit 3. After the musical instrument 20 is removed from the support unit 4 and the frame unit 3, the support unit 4 is pivoted forward by its gravity to return to the first (or initial) position as shown in FIG. 6.

Figure 10:
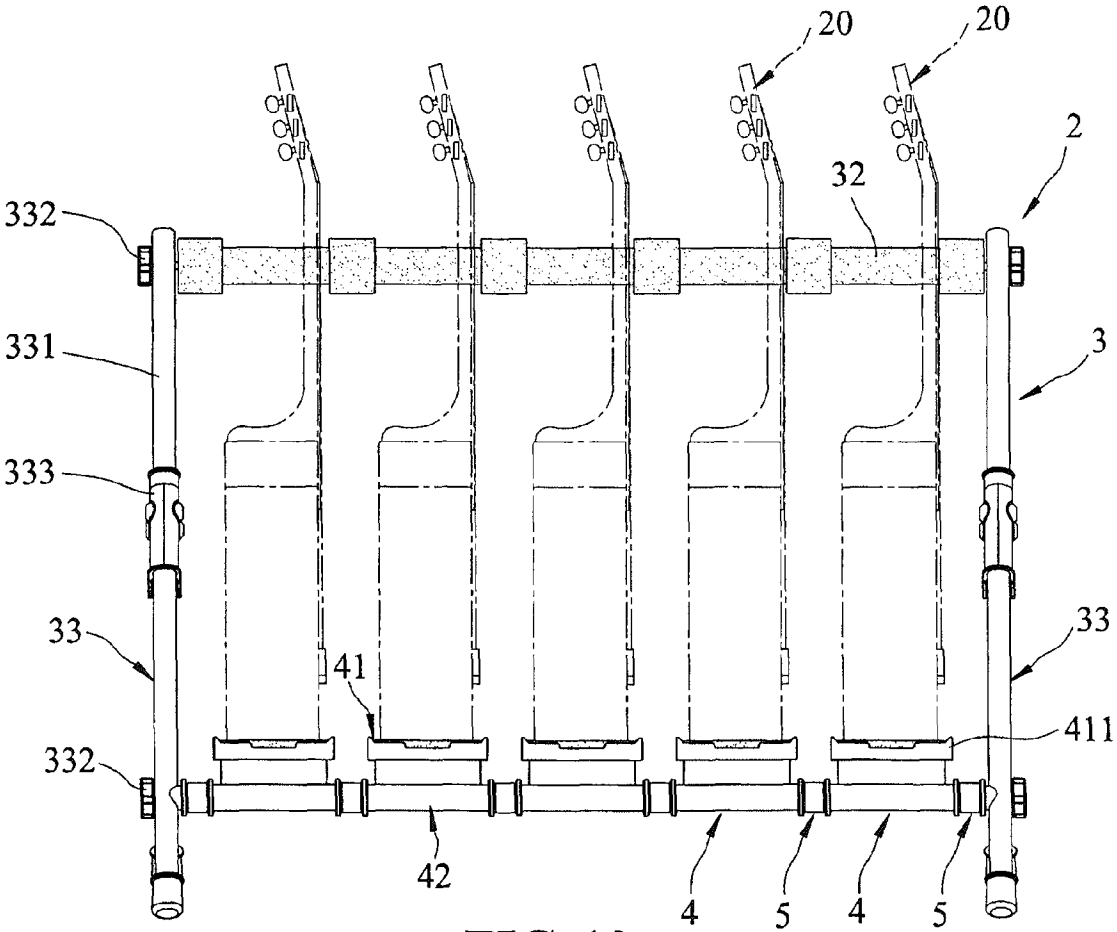
FIG. 10 is a front operational view of the musical instrument stand as shown in FIG. 4.

In the preferred embodiment of the present invention, the musical instrument stand 2 comprises a plurality of support units 4 pivotally mounted on the bottom bar 31 of the frame unit 3 for supporting a plurality of musical instruments 20 as shown in FIG. 10, and a plurality of spacers 5 mounted on the bottom bar 31 of the frame unit 3 and located between the support units 4. The mounting sleeve 42 of each of the support units 4 has two opposite ends each abutting a respective one of the spacers 5. Preferably, the musical instrument stand 2 comprises five support units 4 and six spacers 5.

Accordingly, the support unit 4 is pivotally mounted on the bottom bar 31 of the frame unit 3, so that a user only needs to place the musical instrument 20 on the support unit 4 and to push the musical instrument 20 toward the top bar 32 of the frame unit 3, so as to pivot the support unit 4 and to support the musical instrument 20 between the top bar 32 of the frame unit 3 and the supporting seat 41 of the support unit 4, such that the musical instrument 20 is placed on the musical instrument stand 2 easily and quickly. In addition, the musical instrument 20 is directly placed on the support unit 4 and the top bar 32 of the frame unit 3, so that the user needs not to align the musical instrument 20 with the top bar 32 of the frame unit 3, thereby facilitating the user putting the musical instrument stand 2. Further, the support unit 4 is pivoted forward by its weight unbalance after the musical instrument 20 is removed from the support unit 4 so that the support unit 4 is returned to the initial position automatically. Further, the top bar 32 and the bottom bar 31 of the frame unit 3 are arranged in an inclined manner, so that the musical instrument 20 is supported solidly and stably between the support unit 4 and the frame unit 3 and will not fall out of the musical instrument stand 2 due to an unsteady center of gravity, thereby assuring the safety of placement of the musical instrument 20. Further, the parts of the frame unit 3 can be detached, thereby facilitating and decreasing the cost of packaging, transportation and storage of the musical instrument stand 2. Further, the number of the support units 4 can be changed and adjusted according the user's requirement, thereby enhancing the versatility of the musical instrument stand 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A musical instrument stand, comprising:

a frame unit; and at least one support unit mounted on the frame unit; wherein:

the frame unit includes two side modules spaced from each other;

a top bar mounted between the side modules; and a bottom bar mounted between the side modules and located under the top bar;

the support unit is pivotally mounted on the bottom bar of the frame unit;

the support unit includes:

a supporting seat for supporting a musical instrument; and a mounting sleeve connected with the supporting seat and rotatably mounted on the bottom bar of the frame unit; and the mounting sleeve of the support unit is located at a bottom of the supporting seat and is rotatable along an axis.

2. The musical instrument stand of claim 1, wherein:

the supporting seat of the support unit has a front end portion and a second end portion;

the front end portion and the second end portion of the supporting seat are located at two opposite sides of the mounting sleeve;

a first distance is defined between the front end portion of the supporting seat and the mounting sleeve;

a second distance is defined between the second end portion of the supporting seat and the mounting sleeve; and the first distance is greater than the second distance.

3. The musical instrument stand of claim 1, wherein:

the musical instrument stand further comprises at least one spacer mounted on the frame unit and abutting the support unit; and the spacer is mounted on the bottom bar of the frame unit and abuts one end of the mounting sleeve of the support unit.

4. The musical instrument stand of claim 3, wherein:

the support unit further includes:

a slideway formed in one of the mounting sleeve and the spacer; and a positioning boss formed on the other one of the mounting sleeve and the spacer and slidable in the slideway;

the slideway has a front end provided with a first stop portion corresponding to the front end portion of the supporting seat and a rear end provided with a second stop portion corresponding to the second end portion of the supporting seat; and the support unit is movable relative to the frame unit between a first position where the positioning boss is stopped by the second stop portion of the slideway, and a second position where the positioning boss is stopped by the first stop portion of the slideway.

5. The musical instrument stand of claim 3, wherein:

the support unit comprises a plurality of support units pivotally mounted on the bottom bar of the frame unit, and wherein at least one spacer comprises a plurality of spacers mounted on the bottom bar of the frame unit and located between the support units; and the mounting sleeve of each of the support units has two opposite ends each abutting a respective one of the spacers.

6. The musical instrument stand of claim 3, wherein:

each of the side modules of the frame unit includes:

a side bar abutting the top bar and the bottom bar;

two connectors each detachably locked onto the side bar and each connected with a respective one of the top bar and the bottom bar;

a connecting seat detachably mounted on the side bar; and a support bar detachably connected with the connecting seat and inclined relative to the side bar to support the side bar; and the side bar of each of the side modules is arranged in an inclined manner.

* * * * *